US009888720B2

(12) United States Patent
Chen

(10) Patent No.: US 9,888,720 B2
(45) Date of Patent: Feb. 13, 2018

(54) CARTRIDGE FOR ELECTRONIC CIGARETTE

(71) Applicant: Shenzhen Smoore Technology Limited, Shenzhen, Guangdong (CN)

(72) Inventor: Zhiping Chen, Shenzhen (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 399 days.

(21) Appl. No.: 14/724,839

(22) Filed: May 29, 2015

(65) Prior Publication Data

US 2015/0342258 A1 Dec. 3, 2015

(30) Foreign Application Priority Data

May 30, 2014 (WO) ..... PCT/CN2014/078991

(51) Int. Cl.

| | |
|---|---|
| ***A24F 13/00*** | (2006.01) |
| ***A24F 47/00*** | (2006.01) |
| ***H05B 3/06*** | (2006.01) |
| ***H05B 3/16*** | (2006.01) |

(52) U.S. Cl.

CPC ..... *A24F 47/008* (2013.01); *H05B 3/06* (2013.01); *H05B 3/16* (2013.01); *H05B 2203/014* (2013.01); *H05B 2203/021* (2013.01); *H05B 2203/022* (2013.01)

(58) Field of Classification Search

CPC ..... A24F 47/008
USPC ..... 131/329
See application file for complete search history.

(56) References Cited

U.S. PATENT DOCUMENTS

| | | | | |
|---|---|---|---|---|
| 4,735,217 | A * | 4/1988 | Gerth | A24F 47/008 128/203.17 |
| 5,331,979 | A * | 7/1994 | Henley | A24F 47/002 131/273 |
| 5,799,663 | A * | 9/1998 | Gross | A24F 47/002 131/270 |
| 8,511,318 | B2 * | 8/2013 | Hon | A24F 47/002 128/202.21 |
| 8,910,641 | B2 * | 12/2014 | Hon | A24F 47/002 128/202.21 |
| 2005/0016550 | A1 * | 1/2005 | Katase | A24F 47/002 131/194 |
| 2006/0054165 | A1 * | 3/2006 | Hughes | A61M 15/009 128/200.14 |
| 2009/0151717 | A1 * | 6/2009 | Bowen | A61M 11/041 128/200.23 |
| 2009/0260642 | A1 * | 10/2009 | Monsees | A24F 47/006 131/194 |
| 2011/0120455 | A1 * | 5/2011 | Murphy | A24F 47/002 128/200.18 |
| 2011/0303231 | A1 * | 12/2011 | Li | A24F 47/008 131/329 |

(Continued)

*Primary Examiner* — Tulsidas C Patel
*Assistant Examiner* — Peter G Leigh

(57) ABSTRACT

The present disclosure relates to a cartridge for an electronic cigarette. The cartridge includes a cartridge body defining a smoke channel for smoke flowing therethrough and a reservoir chamber surrounding the smoke channel for storing liquid solution, the reservoir chamber comprising an opening which communicates the interior of the reservoir chamber with the exterior of the reservoir chamber; and a sealing member secured to the cartridge body, the sealing member comprising a first sealing portion for sealing the opening.

20 Claims, 10 Drawing Sheets

(56) References Cited

U.S. PATENT DOCUMENTS

| | | | | |
|---|---|---|---|---|
| 2013/0061861 | A1* | 3/2013 | Hearn | A24F 47/006 131/329 |
| 2013/0192615 | A1* | 8/2013 | Tucker | H01C 17/00 131/328 |
| 2013/0192621 | A1* | 8/2013 | Li | H01C 17/00 131/329 |
| 2013/0192623 | A1* | 8/2013 | Tucker | H01C 17/00 131/329 |
| 2013/0213419 | A1* | 8/2013 | Tucker | A24F 47/008 131/328 |
| 2013/0319438 | A1* | 12/2013 | Liu | A24F 47/008 131/329 |

* cited by examiner

CARTRIDGE FOR ELECTRONIC CIGARETTE

CROSS-REFERENCE TO RELATED APPLICATION

This application claims the benefit of PCT application No. PCT/CN2014/078991, filed on May 30, 2014, which is incorporated herein by reference.

BACKGROUND

1. Technical Field

The present disclosure relates to products for smokers, and more particularly to a cartridge for an electronic cigarette.

2. Description of Related Art

An electronic cigarette is also known as a virtual cigarette or an electronic atomizer. As a substitute for cigarette, the electronic cigarette is usually used for smoking cessation. The appearance and taste of electronic cigarette are similar to those of a conventional cigarette, while it does not contain tar, suspended particles and other harmful ingredients.

An electronic cigarette in a related art usually includes a housing, a suction nozzle portion with a smoking hole mounted to a top end of the housing, a cartridge which is used for storing liquid solution is connected to the suction nozzle portion, and a heating base is connected to the cartridge. A heating unit inside the heating base generally includes fiber rope and nickel chrome wire. The fiber rope is used to absorb the liquid solution from a chamber of the cartridge and thus the liquid solution atomizes under the heating of the nickel chrome wire. For the traditional refillable electronic cigarette, when the liquid solution is used up, there are two ways to refill the liquid solution: one is taken down the heating base to refill the liquid solution, which is able to be repeatedly multiple times; and the other is taken down the suction nozzle portion to refill the liquid solution, which can also be repeatedly multiple times.

The above-mentioned refillable electronic cigarette needs to allocate liquid solution separately. However, the liquid solution is easily contaminated by bacterial if stored or placed improperly. Furthermore, refilling liquid solution into the cartridge and thus reusing the cartridge, an interior of cartridge is easy to be contaminated when the cartridge is open and refill liquid solution. Long-term storage of the liquid solution may easily breed bacteria or cause deterioration for overdue.

SUMMARY

Therefore, an improved cartridge is needed.

A cartridge for an electronic cigarette comprising:

a cartridge body defining a smoke channel for smoke flowing therethrough and a reservoir chamber surrounding the smoke channel for storing liquid solution, the reservoir chamber comprising an opening which communicates the interior of the reservoir chamber with the exterior of the reservoir chamber; and a sealing member secured to the cartridge body, the sealing member comprising a first sealing portion for sealing the opening.

A cartridge for an electronic cigarette comprising:

a cartridge body defining a reservoir chamber for storing liquid solution, the reservoir chamber comprising an opening which communicates the interior of the reservoir chamber with the exterior of the reservoir chamber; and an resilient cover comprising a fixing part and a moving part, the fixing part being fixed on the cartridge body and the moving part covering the opening resiliently.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken. The components in the drawings are not necessarily drawn to scale, the emphasis instead being placed upon clearly illustrating the principles of the embodiments.

DETAILED DESCRIPTION

Illustrative embodiments of the disclosure are below. The following explanation provides specific details for a thorough understanding of the objects, features, and advantages of the invention and enabling description for these embodiments. One skilled in the art will understand that the disclosure may be practiced without such details. In other instances, well-known structures and functions have not been shown or described in detail to avoid unnecessarily obscuring the description of the embodiments.

Unless the context clearly requires otherwise, throughout the description and the claims, when a part is described as "fixed on" another part, it may be installed directly on another part or to be a centered part. When a part is described as "connect" or "connecting" to another part, it may be connected directly to another part or to be a centered part. Additionally, the words "herein," "above," "below" and words of similar import, when used in this application, shall only be for explanatory purposes. When the claims use the word "or" in reference to a list of two or more items, that word covers all of the following interpretations of the word: any of the items in the list, all of the items in the list and any combination of the items in the list.

Figure 1:
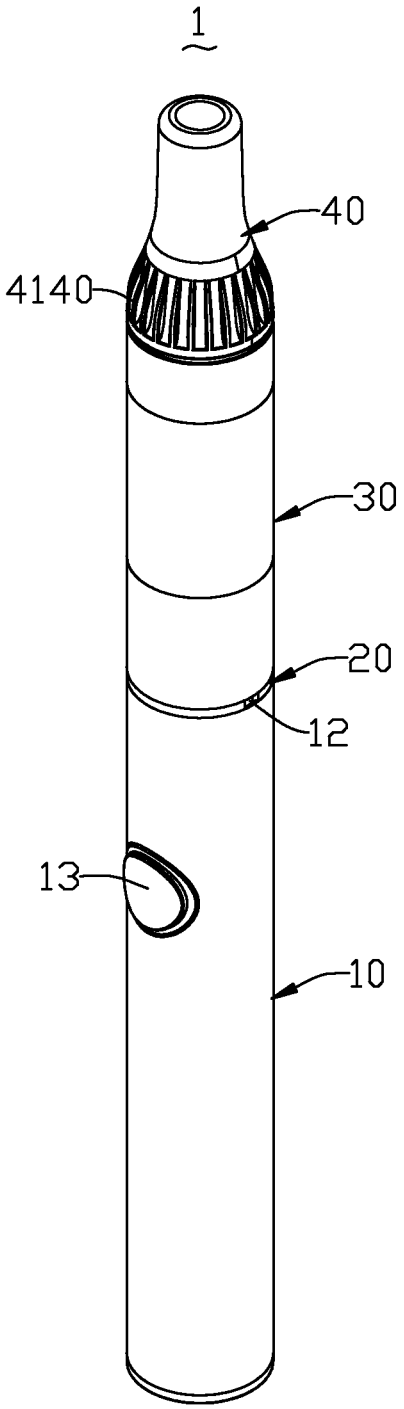
FIG. 1 is a perspective view of an electronic cigarette according to an embodiment of the present invention.
Figure 2:
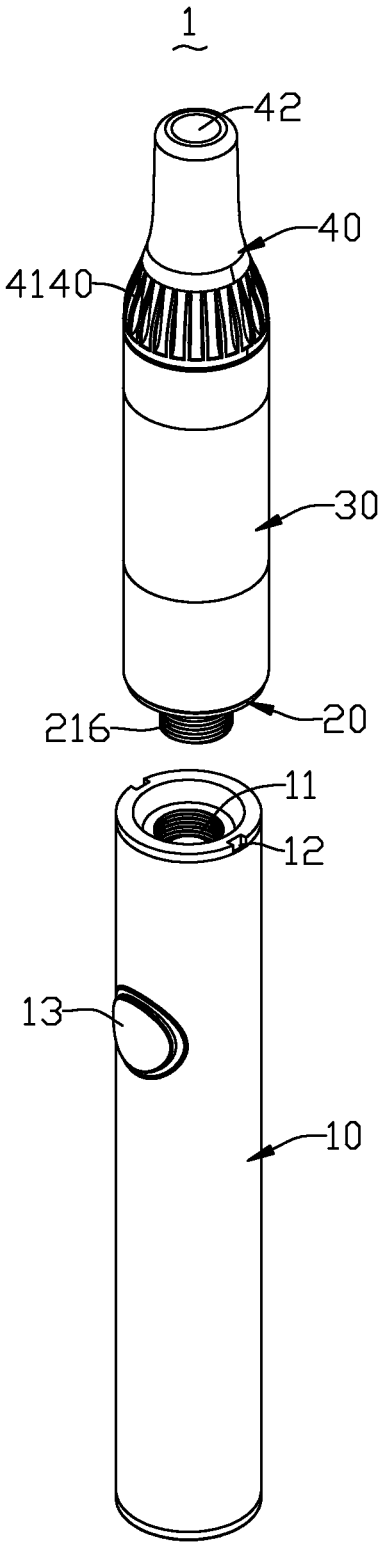
FIG. 2 is an exploded view of the electronic cigarette of FIG. 1.

FIGS. 1 and 2 illustrate an electronic cigarette 1 according to an embodiment of the present invention. The electronic cigarette 1 may include a power supply assembly and an atomizer assembly detachably mounted to the power supply assembly. The power supply assembly, in some embodiments, may include a battery device 10 and is used for supplying power for the atomizer assembly. The atomizer assembly, in some embodiments, may include an atomizer 20 detachably mounted to an end of the battery device 10, a fixing member 30 fixedly mounted to the base 21 of the atomizer 20, and a cartridge 40 detachably mounted to the fixing member 30 and engaged with the atomizer 20. The cartridge 40 is used for storing liquid solution and the atomizer 20 is used for atomizing the liquid solution. The fixing member 30 is used for detachably and rotatably connecting the cartridge 40 with atomizer 20.

Referring to FIG. 2 again, the battery device 10 in some embodiments may be cylindrical, and may include a thread plugging slot 11 defined at one end thereof, an air intake 12 defined on an edge of the one end, and a switch 13 installed on the side wall. The thread plugging slot 11 may be used for a screw joint between the atomizer 20 and the battery device 10, whereby enabling the atomizer 20 and the battery device 10 connected to each other mechanically and electrically. The air intake 12 is used for enabling outside air being sucked into the battery device 10 and then through the battery device 10 to the atomizer 20.

Figure 3:
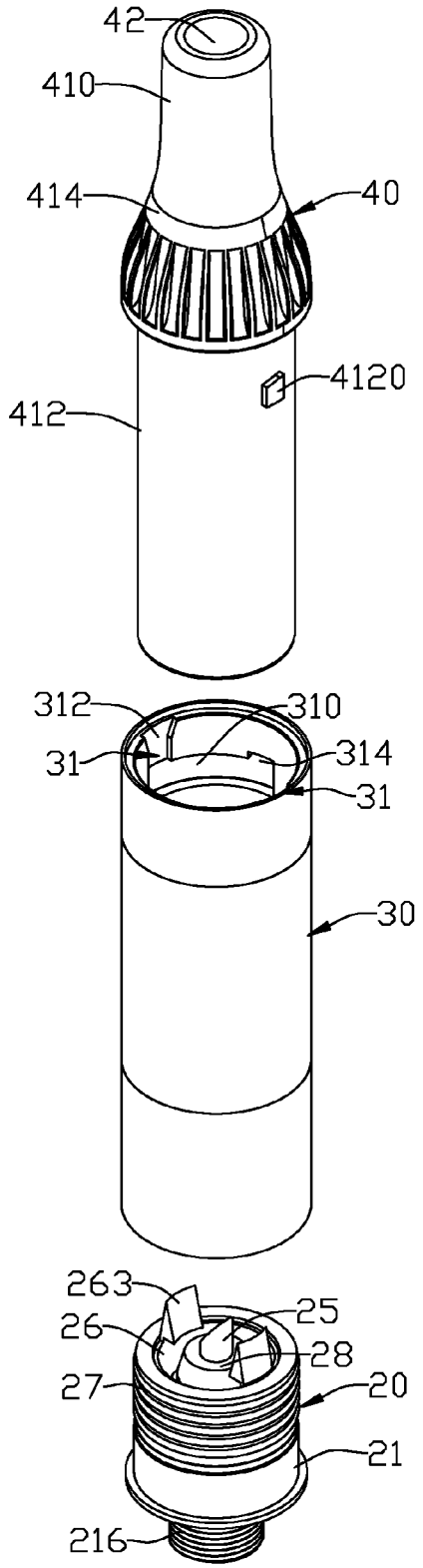
FIG. 3 is an exploded view of an atomizer assembly of the electronic cigarette shown in FIG. 2.
Figure 4:
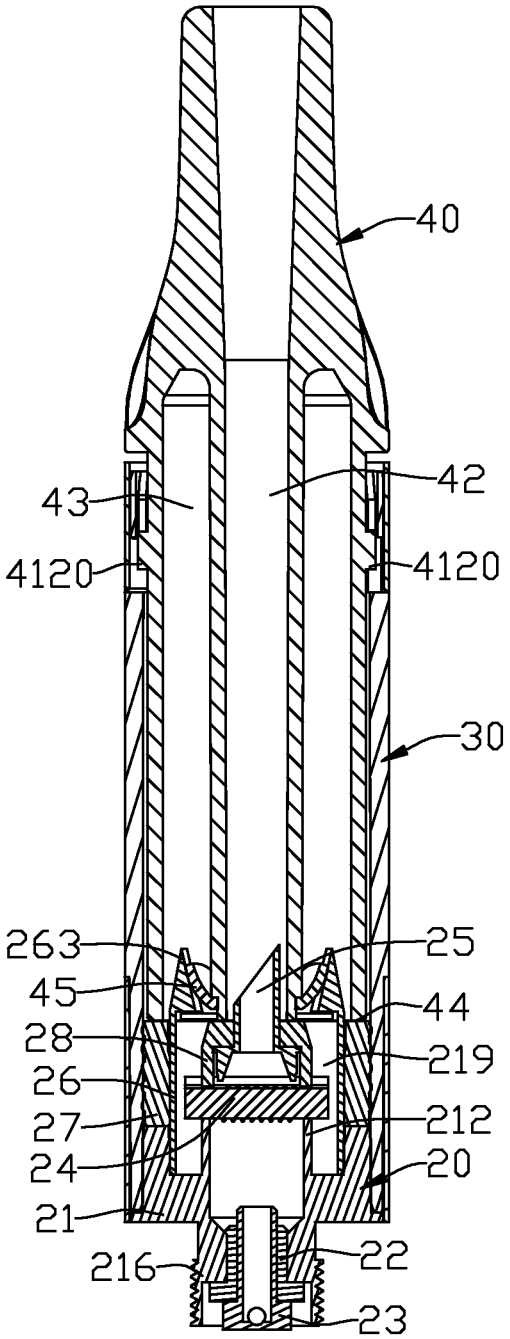
FIG. 4 is an axial cross sectional view of the atomizer assembly shown in FIG. 2.

Referring to FIGS. 3 and 4, the atomizer 20, in some embodiments, may include a base 21 for engaging the thread plugging slot 11 of the battery device 10, and a cylindrical insulator 22, a cylindrical electric conductor 23, an atomizing device 24, a smoke outlet tube 25, a piercing device 26, a first elastic sealing member 27 and a second elastic sealing member 28 mounted to the base 21.

Figure 5:
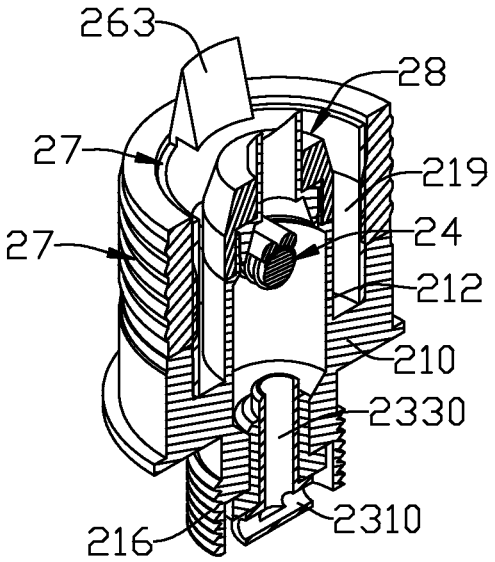
FIG. 5 is an axial cross sectional view of an atomizer of the atomizer assembly shown in FIG. 3.
Figure 6:
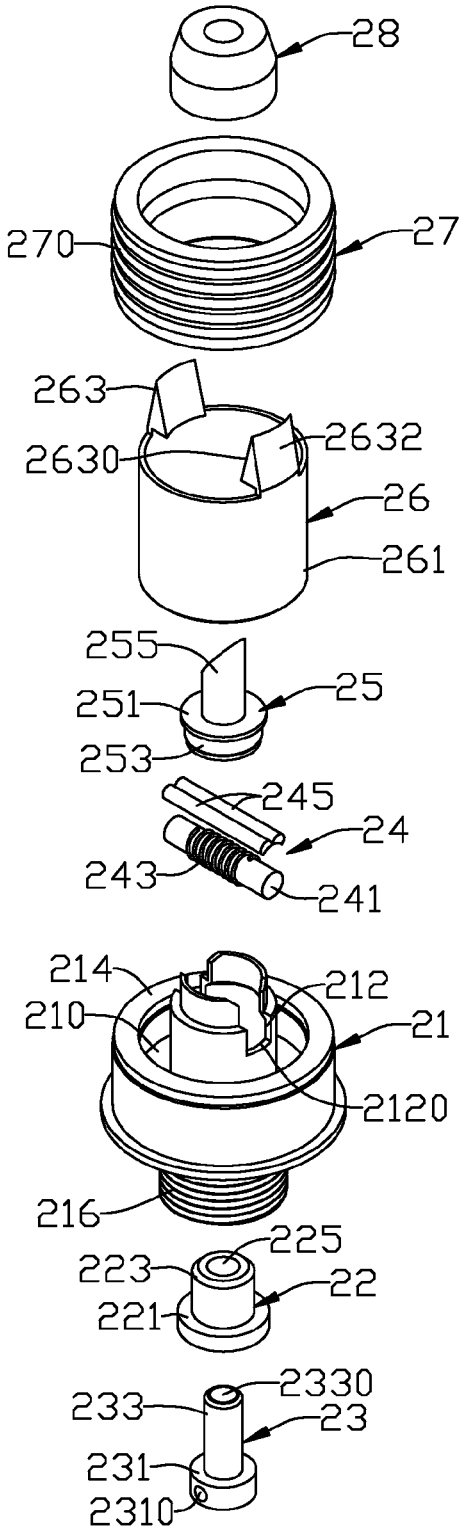
FIG. 6 is an exploded view of the atomizer shown in FIG. 5.
Figure 7:
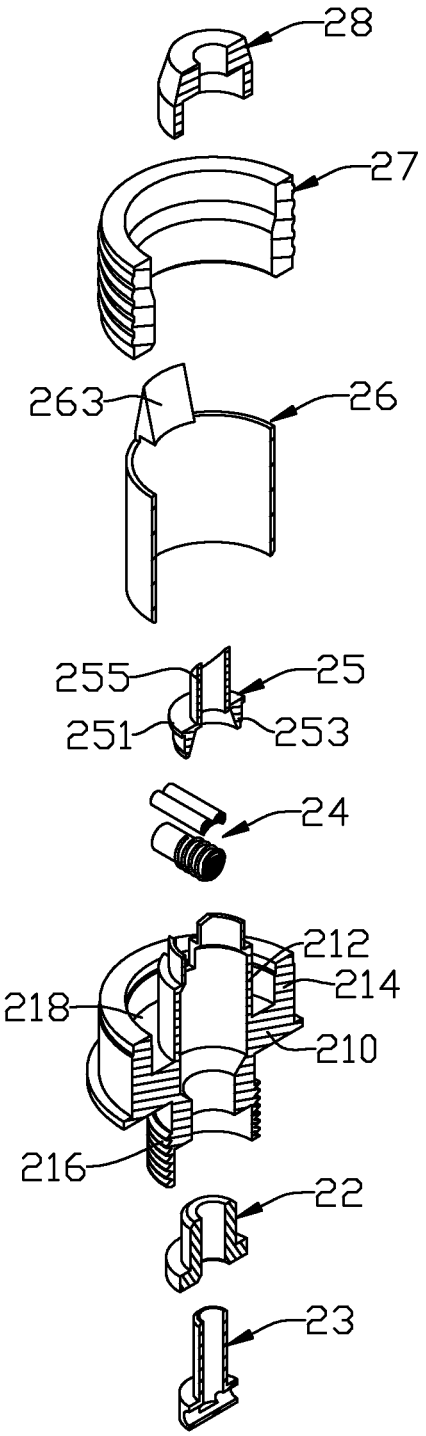
FIG. 7 is a cross sectional view of the atomizer shown in FIG. 5.

Referring to FIGS. 5-7, the base 21 may be made of electrically conductive materials such as copper or aluminum as one-piece, and may be used for electrically connecting the heating coil 243 of the atomizing device 24 with the battery device 10. The base 21 includes an annular bottom wall 210, an air flowing pipe 212 which stands on the middle of a top surface of the annular bottom wall 210, a cylindrical wall 214 which stands on a periphery edge of the top surface of the annular bottom wall 210, and a screw joint 216 connected to a middle of a lower surface of the annular bottom wall 210. The cylindrical wall 214, the annular bottom wall 210 and the air flowing pipe 212 cooperatively define an annular accommodating space 218. The screw joint 216 matches with the thread plugging slot 11 of the battery device 10. The center through-hole of the annular bottom wall 210 is connected to the center through-holes of the air flowing pipe 212 and the screw joint 216, respectively. As shown in FIG. 6, a free end of the air flowing pipe 212 has a receiving slot 2120 concaved towards the annular bottom wall 210, for receiving the atomizing device 24. The air flowing pipe 212 defines an air flowing channel for air flowing therethrough.

The cylindrical insulator 22 in some embodiments may be T-shaped, and may include a flat cylindrical head portion 221 and a cylindrical rod portion 223 connected to the head portion 221. The cylindrical rod portion 223 is embedded inside the center through-hole of the screw joint 216. The head portion 221 abuts against a step of the through-hole of the screw joint 216.

The cylindrical electric conductor 23, in some embodiments, may be used to electrically interconnect the atomizing device 24 and a pole of the battery device 10. The cylindrical electric conductor 21 may be T-shaped, and includes a flat cylindrical head portion 231 and a cylindrical rod portion 233. The head 231 defines a horizontal first hole 2310. The cylindrical rod portion 233 defines a vertical second hole 2330. The first hole 2310 and the second hole 2330 communicate with each other. The cylindrical rod portion 233 is embedded inside the center through-hole of the cylindrical insulator 22. The head 231 abuts against the lower end surface of the head portion 221 of the cylindrical insulator 22, enabling the air to flow through the first hole 2310 to the second hole 2330 then into the center through-hole of the air flowing pipe 212.

The atomizing device 24, in some embodiments, may be laterally placed in the receiving slot 2120 of the air flowing pipe 212. The atomizing device 24 may include a first liquid suction member 241, a heating coil 243 wound around a portion of the first liquid suction member 241 which is located in the air flowing channel of the air flowing pipe 212, and two second liquid suction members 245 disposed side by side upon the first liquid suction member 241. The first liquid suction member 241 and the second liquid suction members 245 may be made of materials with good capillary force, such as fiberglass or natural fiber. The cross-section of the first liquid suction member 241 may be larger in size than that of the second liquid suction member 245. It should be understood that in some embodiments the heating coil 243 may be replaced by other heating unit such as heating sheets. Besides, the second liquid suction member 245 is optional and is able to be omitted.

The smoke outlet tube 25 in some embodiments defines a smoke exhaust channel communicating with the air flow channel, and may include an annular baseplate 251, an embedding portion 253 extending from a bottom surface of the annular baseplate 251, and a cylindrical piercing portion 255 extending from a top surface of the annular baseplate 251. The external diameter of the annular baseplate 251 is greater than the diameter of the opening at the upper end of the air flowing pipe 212. The external diameter of the embedding portion 253 matches with the opening at the upper end of the air flowing pipe 212, thus the embedding portion 253 of the smoke outlet tube 25 is able to be inserted into the outlet of the air flowing pipe 212 and the annular baseplate 251 abuts against an end face of the upper end of the air flowing pipe 212. The cylindrical piercing portion 255 is used for piercing through the second sealing portion 442 of the sealing member 44 of the cartridge 40 into the smoke channel 42 of the cartridge 40. Therefore, smoke generated by the atomizing device 24 is able to be guided to flow into the smoke channel 42. For piercing through the second sealing portion 442 of the sealing member 44 more easily, the top of the piercing portion 255 may be wedge-shaped.

The piercing device 26 in some embodiments may include a tubular body 261 surrounding the reservoir room 219 and a pair of piercing members 263 disposed respectively on two opposite positions of the edge of a top end of the tubular body 261. The external diameter of the tubular body 261 matches with the inner diameter of the cylindrical wall 214, whereby enabling the tubular body 261 tightly embedded in the annular accommodating space 218. When the tubular body 261 is embedded into the annular accommodating space 218, the tubular body 261 together with the annular bottom wall 210 and the air flowing pipe 212 of the base 21 defines a reservoir room 219 surrounding the air flowing pipe 212. The two ends of the first liquid suction member 241 and the second liquid suction member 245 of the atomizing device 24 extend respectively into the reservoir room 219 to suck the liquid solution from the reservoir room 219 to a middle portion where the liquid solution is atomized under the heating of the heating coil 243. It is noteworthy that in some embodiments only one end of the first liquid suction member 241 and the second liquid suction member 245 extend into the reservoir room 219.

The pair of piercing members 263 is used for piercing through the first sealing portion 441 of the sealing member 44 of the cartridge 40, whereby enabling the reservoir chamber 43 of the cartridge 40 and the reservoir room 219 communicating with each other so that the liquid solution in the reservoir chamber 43 may flow into the reservoir room 219. Each piercing member 263 includes an internal surface 2630 facing the central axis of the tubular body 261 and an external surface 2632 which is opposite to the internal surface 2630. The internal surface 2630 and the external surface 2632 intersect on the top end with an acute angle, makes the piercing members 263 be wedge-shaped in profile. Preferably, the internal surface 2630 inclines towards the axis while the external surface 2632 inclines conversely, whereby enabling the whole piercing members 263 to be on the reservoir room 219. The piercing device 26 is for better installation of the first elastic sealing member 27 and the piercing members 263 whereby reducing the difficulty of molding the base 21. It is noteworthy that in some embodiments, the piercing device 26 and the base 21 are integrally formed as one-piece.

The first elastic sealing member 27 in some embodiments may be cylindrical. The first elastic sealing member 27 encircles the piercing device 26 tightly and lets the piercing members 263 exposed. The lower end of the first elastic sealing member 27 abuts against the cylindrical wall 214, and the upper end thereof is used to abut against the end portion of the tube 4122 of the cartridge 40, i.e., the first elastic sealing member 27 fits between the reservoir chamber 43 and the reservoir room 219 to improve sealing effect of the tube 4122 and provide an elastic force to the tube 4122 along a direction away from the atomizing device 24. The first elastic sealing member 27 may include a corrugated outside wall 270 for improving the sealing capability with the inner wall of the fixing member 30 under the pressure from the atomizing device 24.

The second elastic sealing member 28 in some embodiments may also be cylindrical. The second elastic sealing member 28 encircles the piercing portion 255 of the smoke outlet tube 25 tightly and lets the top of the piercing portion 255 exposed. The second elastic sealing member 28 is used to abut against the free end of the tube 4122 of the cartridge 40. In other words, it is disposed between the internal perimeter of the reservoir chamber 43 and the internal perimeter of the reservoir room 219 to improve the sealing capability between the tube 4122 and the smoke outlet tube 25, whereby preventing the liquid solution in the reservoir room 219 from leaking into the smoke channel 42.

Referring to FIG. 3 again, the fixing member 30 in some embodiments may be made of transparent material such that the inside of the cartridge 40 may be observed. Therefore, the user can find if the liquid solution is used up. It should be noted that in some embodiments, only a portion of the fixing member 30 is transparent. The fixing member 30 may be cylindrical with its lower end coupled to the cylindrical wall 214 of the base 21. The internal of the fixing member 30 defines symmetrically a pair of positioning slots 31 for engaging with the latching protrusions 4120 of the cartridge 40. As shown in FIG. 3, each positioning slot 31 include a rotation section 310 extending along a circumferential direction of the fixing member 30. The rotation section 310 is adapted to slidably engage with the latching protrusions 4120 of the cartridge 40, enabling the cartridge 40 being capable of rotating relative to the fixing member 30 along an axis of the atomizer assembly. One end of the rotation section 310 is connected to a guiding section 312 extending along an axis of the fixing member 30. The guiding section 312 extends from the one end of the rotation section 310 to the upper end of the fixing member 30. The other end of the positioning slots 31 is concaved towards the upper end of the fixing member 30 to define a limiting section 314. The limiting section 314 is used for preventing the latching protrusions 228 from returning to rotation 414 enabling the cartridge 40 being positioned in the fixing member 30. It is noteworthy that in some embodiments, the fixing member 30 and the base 21 is able to be integrally formed as one-piece.

Figure 8:
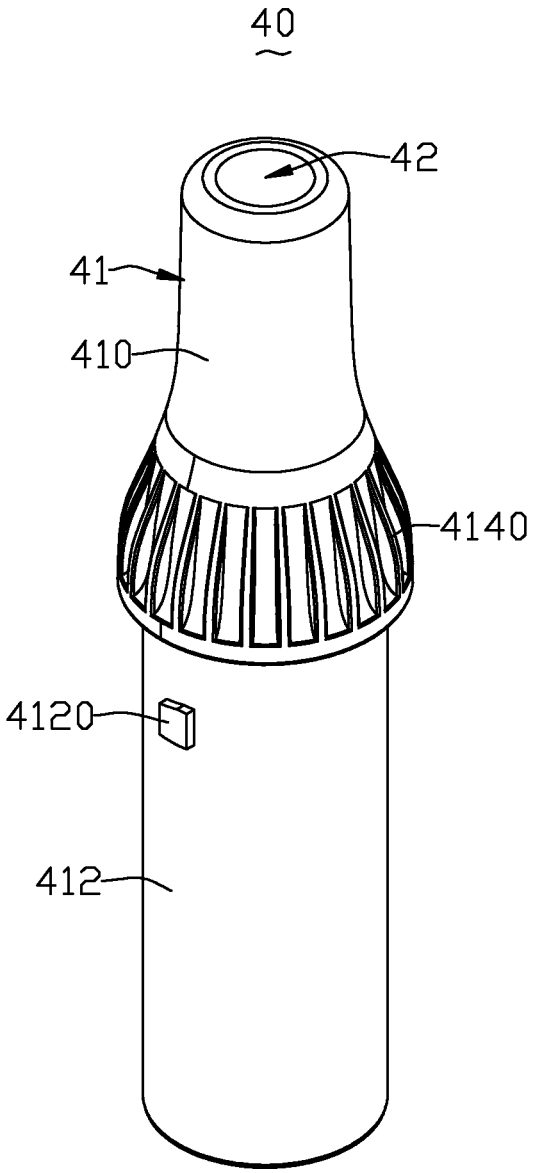
FIG. 8 is a perspective view of a cartridge of the atomizer assembly shown in FIG. 3, the cartridge being sealed.
Figure 9:
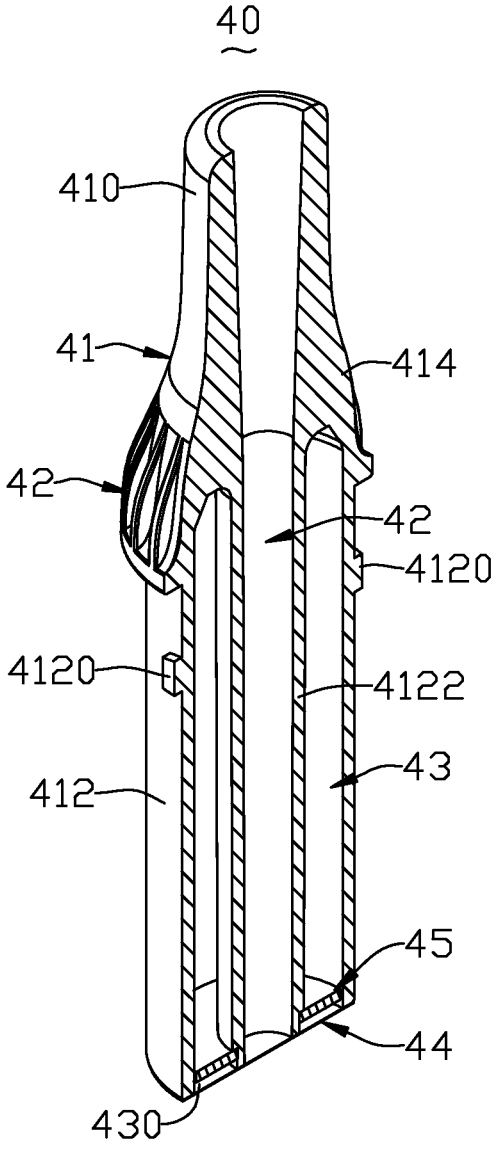
FIG. 9 is an axial cross sectional view of the cartridge shown in FIG. 8.
Figure 10:
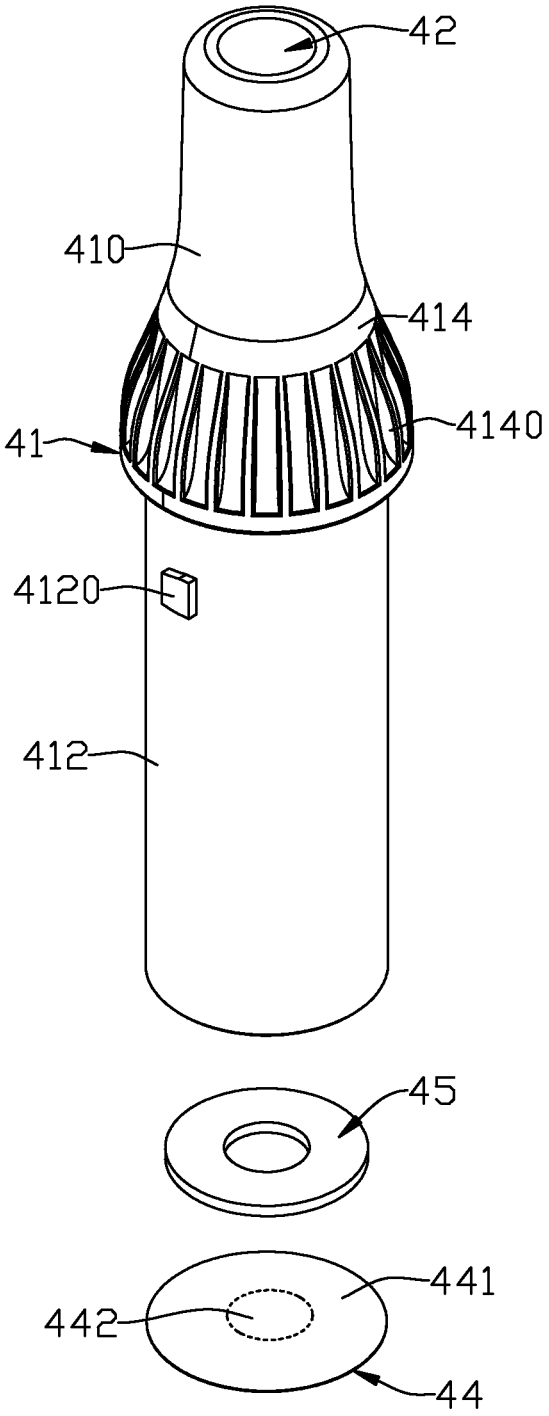
FIG. 10 is an exploded view of the cartridge shown in FIG. 8.

Referring to FIGS. 8-10, the cartridge 40 in some embodiments may include a cartridge body 41 with a smoke channel 42 for smoke flowing therethrough and the reservoir chamber 43 surrounding the smoke channel 42 defined therein. The reservoir chamber 43 in some embodiments is used for storing liquid solution, and may include an opening 430 which communicates the interior of the reservoir chamber 43 with the exterior of the reservoir chamber 43. Preferably, the smoke channel 42 extends through the cartridge body 41 along a longitudinal direction. The opening 430 and the inlet of the smoke channel 42 may be coplanar. The opening 430 may be substantially annular-shaped, and the inlet may be substantially circular-shaped.

The cartridge body 41 in some embodiments may be made of transparent material so that the liquid solution in the reservoir chamber 43 may be observed in real time. The cartridge body 41 includes a suction nozzle portion 410, an embedding portion 412, and a transition portion 414 connecting the suction nozzle portion 410 with the embedding portion 412. The smoke channel 42 extends through the suction nozzle portion 410, the transition portion 414 and the embedding portion 412 in sequence. The diameter of a portion of the smoke channel 42 within the suction nozzle portion 410 may increase gradually along a direction towards the free end of the suction nozzle portion 410, enabling the speed of the smoke to the smoker's mouth decreases, thereby improving the smoking experience. The suction nozzle portion 410 and the embedding portion 412 in some embodiments may substantially be cylindrical. The size of the suction nozzle portion 410 should be comfortable for smokers. The diameter of the embedding portion 412 is greater than that of the suction nozzle portion 410, but fits the inner diameter of the fixing member 30, whereby enabling the embedding portion 412 to be embedded in the fixing member 30. The transition portion 414 has a shape of truncated cone, with a plurality of anti-slip protrusions formed on the outer surface thereof and spaced from each other, facilitating the smokers to rotate the cartridge 40. In some embodiments, a pair of latching protrusions 4120 is respectively formed on two opposite sides of the outer surface of the embedding portion 412, and is adjacent to the transition portion 414. The pair of latching protrusions 4120 is engaged with the positioning slots 31, respectively. In detail, in some embodiments, the latching protrusion 228 may be substantially rectangular.

The embedding portion 412, in some embodiments, may further include a tube 4122. The tube 4122 is used for separating the reservoir chamber 43 from the smoke channel 42. The opening 430 is defined on the surface of the free end of the embedding portion 412.

Referring to FIG. 10, the cartridge 40 in some embodiments further includes a sealing member 44. The sealing member 44 in some embodiments is generally a circular sheet which includes a substantially annular-shaped first sealing portion 441 for sealing the opening 430 of the reservoir chamber 43, and a substantially circular-shaped second sealing portion 442 for sealing the inlet of the smoke channel 42. The sealing member 44 may be made from materials with certain rigidity but easy to be pierced through. Thus, in one aspect, the liquid solution before usage is able to be held within the reservoir chamber 43 by the sealing member 44 and be prevented from leaking easily. In another aspect, a sharp object can be pierced through the sealing member 44 easily to make the liquid solution flow out from the reservoir chamber 43 and then flow to the atomizer 20. In some embodiments, the sealing member 44 may be made of silver paper. In other embodiments, the sealing member 44 may be made of other sheet-like materials like plastic paper. It should be understood that the second sealing portion 442 is optional.

The cartridge 40 in some embodiments may further include an resilient cover 45 which is mounted to the cartridge body 41. The resilient cover 45 may be located within the reservoir chamber 43 and be adjacent to the opening 430. The resilient cover 45 covers the opening 430 resiliently, such that when the sealing member 44 is pierced through and the piercing members 263 are removed, the opening 430 will be covered. The resilient cover 45 in some embodiments may be annular and sheet-shaped, and may be made from soft, elastic material like silica gel. The external diameter of the resilient cover 45 may be equal to or slightly smaller than the external diameter of the reservoir chamber 43. The inner periphery of the resilient cover 45 is fixed on the free end of the tube 4122 to form a fixing part of the resilient cover 45. The outer periphery of the resilient cover 45 extends laterally from the tube 4122 to or adjacent to the inner wall of the reservoir chamber 43 to form a moving part of the resilient cover 45. The outer periphery of the resilient cover 45 can overturn with respect to the inner periphery, whereby enabling the opening 430 of the reservoir chamber 43 exploding when the outer periphery has an external force applied thereon, and enabling the resilient cover 45 returning to cover the opening 430 when the external force is moved.

Assembly and usage of the electronic cigarette 1 will be further illustrated as below.

In some embodiments, the cartridge 40 may be sold independently. In other words, the cartridge 40 is filled with liquid solution in the factory, and is sealed by the sealing member 44. When installing the cartridge 40 onto the atomizer 20, plug the embedding portion 412 into the fixing member 30 and ensure the pair of latching protrusions 4120 of the embedding portion 412 inserted into the guiding section 312 of the positioning slots 31 on the inner wall of the fixing member 30. Then, the second sealing portion 442 of the sealing member 44 will come into contact with the smoke outlet tube 25. At this time, continue to force the cartridge 40 downwards will make the smoke outlet tube 25 pierce through the second sealing portion 442 and further extending into the internal of the smoke channel 42. Subsequently, the first sealing portion 441 of the sealing member 44 will come into contact with the top of the piercing members 263. In this situation, continue to force the cartridge 40 downwards will make the piercing members 263 pierce through the first sealing portion 441 and drive the outer periphery of the resilient cover 45 to overturn resiliently with respect to the inner periphery, thus the liquid solution in the reservoir chamber 43 can flow out and further flow into the reservoir room 219 (referring to FIG. 4). Therefore, the piercing members 263 also act as lifting members for lifting the outer periphery of the resilient cover 45.

The first elastic sealing member 27 which may be made of silica gel has function of sealing, and prevents the liquid solution from leaking from gaps between the embedding portion 412 and the fixing member 30. The end of the embedding portion 412 encounters the first elastic sealing member 27, and an obvious resistance is generated. Continue to force the cartridge 40 downwards to overcome the elastic force applied by the first elastic sealing member 27 until the pair of latching protrusions 4120 are inserted into the bottoms of the guiding section 312. In such a state, the cartridge 40 is able to be rotated a certain angle relatively to the fixing member 30 to make the pair of latching protrusions 4120 slide along the rotation section 310 of the positioning slots 31 into the limiting section 314. Then stop forcing the transition portion 414, under the elastic force of the first elastic sealing member 27, the pair of latching protrusions 4120 may be fixedly latched within the limiting section 314 and will not easy to disengage from the limiting section 314, thereby the cartridge 40 and the atomizer 20 are fixedly assembled. Compared with the traditional screw type twisted structure, this design can prevent the cartridge 40 from disengaging by rotating when children are playing, thereby the safety of usage of the product is enhanced. It should be noted that other types of protrusion-slot structures may be used to realize the detachable connection. It is also noteworthy that during the rotation of the cartridge 40 relative to the fixing member 30, the piercing members 263 cuts the first sealing portion 441 along a circumferential direction and forms an elongated strip-shaped through hole in the first sealing portion 441 so that the liquid solution may flow into the reservoir room 219 smoothly.

In use, when the switch 13 is turned on, the heating coil 243 of the atomizing device 24 is powered and generates heat, and atomizes the liquid solution in the first liquid suction member 241 and the second liquid suction member 245. When inhale at the suction nozzle portion 410 of the electronic cigarette 1, the air flows into the battery device 10 via the air intake 12 and then flows through the first hole 2310 and the second hole 2330 of the cylindrical electric conductor 23 in sequence to the inside of the air flowing pipe 212 of the atomizer 20. The airflow drives the smoke flow towards the user's mouth through the smoke outlet tube 25 and the smoke channel 42.

When the liquid solution in the cartridge 40 is used up, the atomizer 20 may be reused and the cartridge 40 may be replaced, thereby the electronic cigarette 1 can be reused again. To disassemble the cartridge 40, firstly forces the cartridge 40 downwards to overcome the elastic force of the first elastic sealing member 27. When the pair of latching protrusions 4120 reaches the bottom of the limiting section 314, the transition portion 414 is driven to rotating reversely relative to the fixing member 30, whereby enabling the pair of latching protrusions 4120 moving into the guiding section 312, thus, the cartridge 40 is able to be withdrawn from the fixing member 30 easily. When the cartridge 40 is disassembled, the piercing members 263 separate from the cartridge 40. The resilient cover 45 will be back to an original position since the external force on the outer periphery applied by the piercing members 263 is removed, and the resilient cover 45 will cover the opening 430 of the reservoir chamber 43 of the cartridge 40 again, and prevent or significantly reduces leakage of the remaining liquid solution in reservoir chamber 43 of the cartridge 40, and accordingly prevent or reduces significantly the contamination of the liquid solution to the users' hands, the atomizer 20 and/or the fixing member 30 during disassembling the cartridge 40.

The electronic cigarette 1 as described above can achieve at least the following advantages:

1) The liquid solution is accommodated in the cartridge and sealed by the sealing member 44 in the factory, so that the problems due to stored or placed improperly is able to be avoid and the liquid solution will not be contaminated of bacterial or others.

2) The refillable cartridge is modified to be disposable cartridge 40, the liquid solution is stored within the cartridge 40, thus avoid the contamination from outside to ensure the cleanness.

3) The disposable cartridge 40 is totally sealed to prevent children swallowing or spreading the liquid solution on skin or in eyes.

4) The disposable cartridge 40 need not to be filled by the users, thus avoid leakage of liquid solution due to improper operation or overfill, whereby improving the user experience.

5) The structure of the atomizer assembly is simple, which can avoid leakage due to size problems, and reduce worker's burden during manufacturing procedure.

6) When disassembling the cartridge 40, the resilient cover 45 will cover the opening of the reservoir chamber 43 of the cartridge 40, thus avoid leakage of the remaining liquid solution in reservoir chamber 43, whereby preventing or reducing significantly the leakage of the remaining liquid solution.

7) The atomizing device 24 includes the bigger first liquid suction member 241, the heating coil 243 wound around the first liquid suction member 241 in the air flowing pipe 212 and two smaller second liquid suction members 245 above the first liquid suction member 241, improving the atomization efficiency significantly and generating more smoke.

8) By adopting the designed piercing members 263, the through hole that pierced on the first sealing portion 441 of the sealing member 44 is bigger, so that the liquid solution in the reservoir chamber 43 may flow into the reservoir room 219 more smoothly.

It is noteworthy that, although information as to, and advantages of, the present embodiments have been set forth in the foregoing description, together with details of the structures and functions of the present embodiments, the disclosure is illustrative only; and changes may be made in detail, especially in the matters of shape, size, and arrangement of parts within the principles of the present embodiments to the full extent indicated by the broad general meaning of the terms in which the appended claims are expressed.

What is claimed is:

1. A cartridge for an electronic cigarette comprising: a cartridge body defining a smoke channel for smoke flowing therethrough and a reservoir chamber surrounding the smoke channel for storing liquid solution, the reservoir chamber comprising an opening which communicates the interior of the reservoir chamber with the exterior of the reservoir chamber; and a sealing member secured to the cartridge body, the sealing member comprising a first sealing portion for sealing the opening; the cartridge comprising a resilient cover, the resilient cover comprising a fixing part and a moving part, the fixing part being fixed on the cartridge body and the moving part covering the opening resiliently; wherein the resilient cover is located within the reservoir chamber, the cartridge body comprises a tube for separating the reservoir chamber from the smoke channel, the resilient cover is substantially annular-shaped, the external diameter of the resilient cover is equal to or slightly smaller than the external diameter of the reservoir chamber, the inner periphery of the resilient cover is fixed on a free end of the tube, and the outer periphery of the resilient cover extends laterally from the tube to or adjacent to the inner wall of the reservoir.

2. The cartridge as described in claim 1, wherein the sealing member comprising a second sealing portion for sealing an inlet of the smoke channel.

3. The cartridge as described in claim 2, wherein the opening and the inlet are coplanar.

4. The cartridge as described in claim 3, wherein the first sealing portion and the opening are substantially annular-shaped, and the second sealing portion and the inlet are substantially circular-shaped.

5. The cartridge as described in claim 1, wherein the sealing member is made of silver paper.

6. The cartridge as described in claim 1, wherein at least a portion of the cartridge body is transparent.

7. The cartridge as described in claim 1, wherein the cartridge body comprises a suction nozzle portion, an embedding portion, and a transition portion connecting the suction nozzle portion with the embedding portion, the smoke channel extends through the suction nozzle portion, the transition portion and the embedding portion in sequence.

8. The cartridge as described in claim 1, wherein the cartridge body comprises a suction nozzle portion with a plurality of anti-slip protrusions formed on the outer surface thereof, and the plurality of anti-slip protrusions is spaced from each other.

9. The cartridge as described in claim 1, wherein the cartridge body comprises an embedding portion, and a pair of latching protrusions is formed on the outer surface of the embedding portion.

10. A cartridge for an electronic cigarette comprising: a cartridge body defining a reservoir chamber for storing liquid solution, the reservoir chamber comprising an opening which communicates the interior of the reservoir chamber with the exterior of the reservoir chamber; and an resilient cover comprising a fixing part and a moving part, the fixing part being fixed on the cartridge body and the moving part covering the opening resiliently; wherein the cartridge body comprises a tube for separating the reservoir chamber from the smoke channel, the resilient cover is substantially annular-shaped, the external diameter of the resilient cover is equal to or slightly smaller than the external diameter of the reservoir chamber, the inner periphery of the resilient cover is fixed on a free end of the tube, and the outer periphery of the resilient cover extends laterally from the tube to or adjacent to the inner wall of the reservoir.

11. The cartridge as described in claim 10, wherein the cartridge body further defines a smoke channel for smoke flowing therethrough, the smoke channel extends longitudinally through the cartridge body, and the reservoir chamber surrounds the smoke channel.

12. The cartridge as described in claim 11, wherein the cartridge body comprises a suction nozzle portion, an embedding portion, and a transition portion connecting the suction nozzle portion with the embedding portion, the smoke channel extends through the suction nozzle portion, the transition portion and the embedding portion in sequence.

13. The cartridge as described in claim 11, wherein the cartridge body comprises a suction nozzle portion with a plurality of anti-slip protrusions formed on the outer surface thereof, and the plurality of anti-slip protrusions is spaced from each other.

14. The cartridge as described in claim 11, wherein the cartridge body comprises an embedding portion, and a pair of latching protrusions is respectively formed on two opposite sides of the outer surface of the embedding portion.

15. The cartridge as described in claim 11, wherein the opening are substantially annular-shaped, and the inlet are substantially circular-shaped.

16. The cartridge as described in 11, wherein the sealing member comprises a first sealing portion for sealing the opening.

17. The cartridge as described in claim 16, wherein the sealing member comprises a second sealing portion for sealing an inlet of the smoke channel.

18. The cartridge as described in claim 17, wherein the first sealing portion is pierced through to communicate the reservoir chamber with an atomizing device when the cartridge is connected to the atomizing device to allow the liquid solution to be atomized by the atomizing device; the second sealing portion is pierced through to communicate the smoke channel with the atomizing device when the cartridge is connected to the atomizing device.

19. The cartridge as described in claim 10, wherein the resilient cover is located within the reservoir chamber.

20. The cartridge as described in claim 10, wherein at least a portion of the cartridge body is transparent.

* * * * *